United States Patent [19]

Vazquez

[11] Patent Number: 4,527,022

[45] Date of Patent: Jul. 2, 1985

[54] TAP CHANGER

[76] Inventor: Frank B. Vazquez, 217 E. Enid Dr., Key Biscayne, Fla. 33149

[21] Appl. No.: 597,371

[22] Filed: Apr. 10, 1984

[51] Int. Cl.[3] ..... H01H 19/56

[52] U.S. Cl. ..... 200/8 R; 200/11 TC; 200/277

[58] Field of Search ..... 200/8 R, 8 H, 11 R, 200/11 A, 11 B, 11 C, 11 J, 11 K, 11 TC, 277

[56] References Cited

U.S. PATENT DOCUMENTS

| | | | |
|---|---|---|---|
| 1,412,002 | 4/1922 | Hendricks | 200/277 X |
| 1,725,078 | 8/1929 | Hill | 200/8 R |
| 2,753,432 | 7/1956 | Long et al. | 200/277 X |
| 2,765,454 | 10/1956 | Long | 200/277 X |
| 2,903,530 | 9/1959 | Wilson, Jr. | 200/11 TC |
| 3,170,048 | 2/1965 | Glatz et al. | 200/8 R |
| 3,346,707 | 10/1967 | Bock et al. | 200/8 R |
| 3,467,794 | 9/1969 | Ristuccia | 200/11 TC |
| 3,652,812 | 3/1972 | Ristuccia | 200/11 TC X |

FOREIGN PATENT DOCUMENTS

| | | | |
|---|---|---|---|
| 2040576A | 8/1980 | United Kingdom | 200/11 TC |

*Primary Examiner*—J. R. Scott

*Attorney, Agent, or Firm*—Shlesinger Arkwright Garvey & Fado

[57] ABSTRACT

A tap changer is adapted for being mounted both internally and externally to a transformer. The tap changer includes a frame having a planar portion and a flange portion generally transverse thereto. A plurality of contacts extend from the planar portion and are adapted for engaging the associated contacts of the transformer. A pivot control assembly is connected to the flange portion and defines a pivot axis. A shaft having a female coupling system adapted for engaging the pivot control assembly is mounted thereto for rotating the shaft. A brace is provided for positioning the shaft coupling system on the pivot control system. A displaceable disk having a spring mechanism is adapted for engaging the contacts while also simultaneously maintaining engagement of the coupling systems.

29 Claims, 7 Drawing Figures

TAP CHANGER

BACKGROUND OF THE INVENTION

A tap changer is an electrical switch customarily utilized with transformers to obtain a voltage ratio which is slightly different from the standard ratio obtained with the complete high voltage winding. A plurality of contacts in the tap changer are connected to taps in the high voltage winding of the transformer. Tap changers usually have five positions or steps in order to allow a change of either two steps above and two steps below or four steps below the rated voltage. These steps are usually 2.5% of rated voltage. The switching action is obtained by shorting two adjacent contacts and thus changing the number of turns of the high voltage winding of the transformer. The switching action is, preferably, done while the transformer is de-energized.

The prior art tap changers have been relatively complicated electromechanical devices which have been expensive to manufacture and difficult to assemble. The tap changer contacts have typically had relatively thin upper walls, preferably crimped to a cable, and thick bottom walls for strengthening purposes. The manufacture of these contacts has been relatively expensive because of this construction.

Prior art tap changers have also had difficulty with the problem of tracking. Tracking is the conduction of electricity between two dielectric substances from two different voltage levels. This tracking reduces the life of the tap changer. A further difficulty with prior art tap changers has been the necessity of using one tap changer which may be mounted inside the transformer cabinet while requiring the utilization of a separately designed tap changer which is mounted externally of the transformer cabinet.

U.S. Pat. No. 3,652,812, discloses a tap changer switch having a radially directed pressurized movable contact assembly. The switch of Ristuccia is, however, a very complicated structure which is relatively expensive to manufacture and difficult to assemble. The tap changer of Ristuccia requires the utilization of a double shaft assembly. Assembly of the tap changer is complicated by the orifices through which the shafts pass.

OBJECTS AND SUMMARY OF THE INVENTION

In view of the above noted deficiencies and disadvantages of the prior art, a novel tap changer switch which may be inexpensively manufactured while also easily assembled is advantageous. The present tap changer switch includes a frame having an arcuate annular portion from which a plurality of contacts depend. A bottom flange portion is integral with the annular portion and includes a male coupling member. A spring loaded contact wheel is displaceably mounted to a bracing member which is secured to a rotatable shaft. The shaft includes a female arcuate recess cooperatively engaging the male coupling member. The shaft carrying the disk may be readily inserted into engagement with an associated two of the contacts while also easily engaged with the male coupling member. A planar support is disposed adjacent the annular frame portion in order to insure proper positioning of the female coupling member relative to the male coupling member. Consequently, one skilled in the art will appreciate that the above recited tap changer switch represents a new and unique advancement in the tap changer switch area.

A primary object of the disclosed invention is to provide a tap changer switch overcoming the disadvantages of prior art switches.

Another object of the disclosed invention is to provide a tap changer switch which may be efficiently manufactured by injection molding or the like from polymeric materials at relatively low cost.

Still another object of the disclosed invention is to provide a tap changer switch which may be quickly and readily assembled and which has a minimum number of parts.

Yet another object of the disclosed invention is to provide a tap changer module which can be assembled and disassembled without tools and fasteners.

Still another object of the disclosed invention is to provide a tap changer switch in which a spring-loaded displaceable copper, brass or copper clad disk engages the contacts while also simultaneously maintains cooperative engagement of the rotatable shaft with the male pivot member.

Yet a further object of the disclosed invention is to provide a tap changer switch having two planar support members for assuring proper positioning of the male and female connection members.

Yet still a further object of the disclosed invention is to provide a tap changer switch which may be utilized both internally and externally in an electrical transformer.

Yet still another object of the disclosed invention is to provide a tap changer switch having an improved contact assembly which employs standard copper tubing with a flared, knurled or otherwise deformed end to frictionally hold the contact tubes to the plastic base. The tubes, as well as the studs, are preferably inserted into the mold at the time of molding and remain firmly attached to the stationary base when the part is ejected. The studs can be inserted into the mold for use in either of two alternate positions. When the tap changer is intended for inside operation, then the studs are inserted in the mold in an upward position opposite to the direction of the tube terminals inserts. When the tap changer is intended to be used for outside operation, then the studs are inserted in the opposite direction away from the tank wall and in the same direction as the tube terminals. This alternate insertion of the studs in the mold is accomplished by interchangeable assemblies of magnets and retaining sleeves in the mold.

An additional object of the disclosed invention is to provide a tap changer switch having a spring loaded contact assembly for assuring engagement of the contact assembly with the electrical contacts.

These and other objects and advantages of the invention will be readily apparent in view of the following description and drawings of the above described invention.

DESCRIPTION OF THE DRAWINGS

The above and other objects and advantages and novel features of the present invention will become apparent from the following detailed description of the preferred embodiment of the invention illustrated in the accompanying drawings, wherein.

DESCRIPTION OF THE INVENTION

Figure 1:
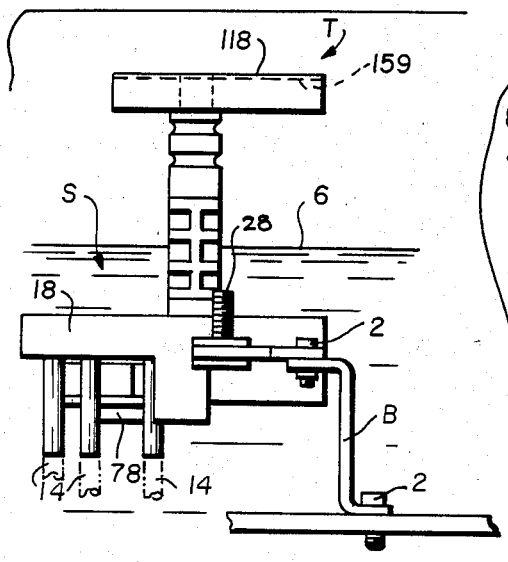
FIG. 1 is a side elevational view with portions broken away of my tap changer switch mounted in the top end of the core and coil assembly of a transformer for operation from inside of the transformer and with tap cables shown in phantom lines.

Tap changer switch S, as best shown in FIG. 1, is vertically mounted in the top end plate of the core and coil assembly of transformer T by means of bracket B which is secured by bolts 2 to mounting holes 4 of the tap changer S. The complete tap changer S is mounted inside the transformer tank with oil level 6 above the tap changer S mechanism and connections and below the handle and a substantial part of the shaft as shown. Access to the handle of the tap changer is obtained through a hand hole in the cover of the tank.

Figure 2:
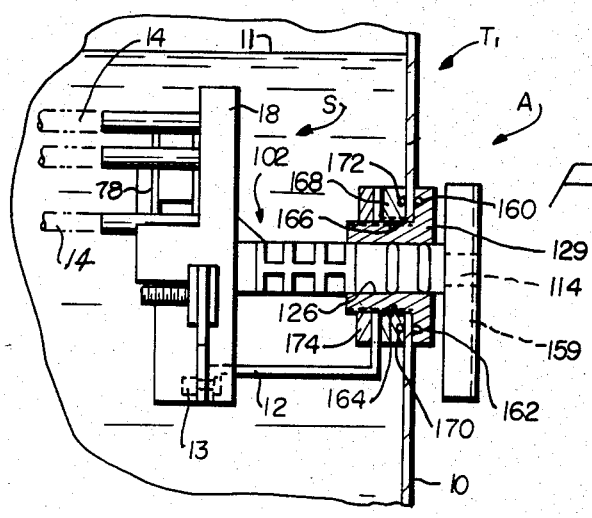
FIG. 2 is a side elevational view of the tap changer of FIG. 1 mounted in a transformer tank wall and disclosing a sealing assembly and with tap cables shown in phantom lines.

As shown in FIG. 2, tap changer switch S is shown horizontally mounted in the transformer tank wall 10 by means of bracket 12 and sealing assembly A which is attached to bracket 12 and tap changer S. Oil level 11 is above the complete tap changer S and sealing assembly A.

A bracket assembly 12 is secured to the sealing assembly A between sealing annular plate 168 and nut 174. Bracket 12 is secured to switch S by bolts 13 secured in holes 4. A plurality of electrical cable taps 14 from the high voltage winding of the transformer are electrically connected with terminals 56–66 of tap changer switch S by crimping or other means, as is well known in the art. While three electrical tap cables 14 are disclosed in FIGS. 1 and 2, one skilled in the art will appreciate that a greater or fewer number may be utilized without detracting from the inventive concept of the invention.

Figure 6:
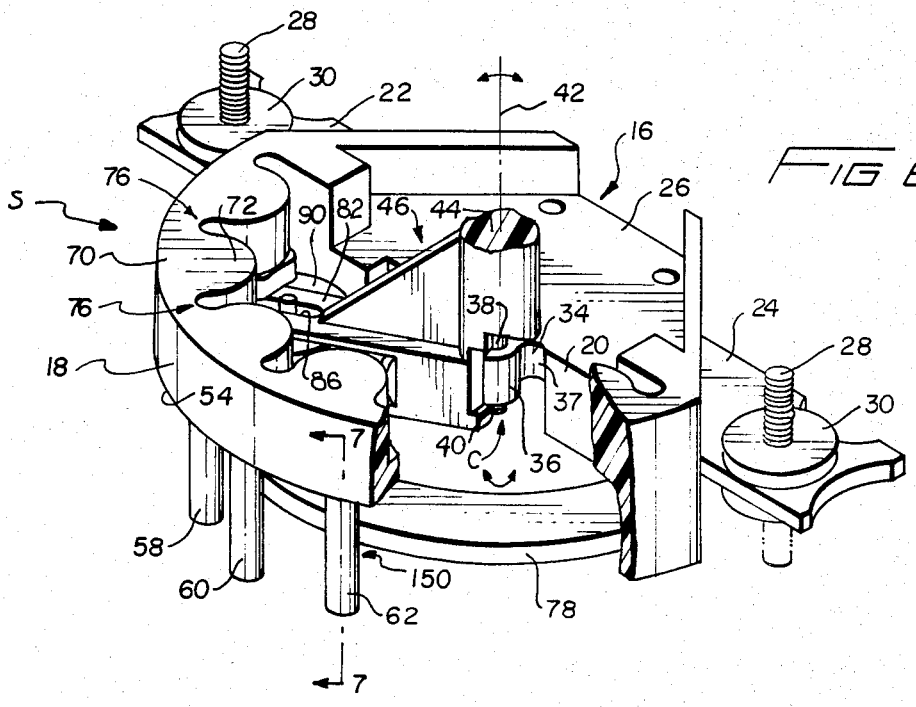
FIG. 6 is a fragmentary perspective view with portions broken away of the tap changer switch; and, FIG. 7 is a cross-sectional view taken along the section 7—7 of FIG. 6 and disclosing the manner in which the contacts are inserted and secured in the base of the tap changer.

As best shown in FIG. 6, switch S includes a frame 16 comprising an annular-shaped substantially planar portion 18 and an integral flange portion 20. Planar portion 18 extends arcuately upwardly from flange portion 20 which is disposed transversely of the plane of planar portion 18. Mounting holes 4 in base or main portion 26 provide means for mounting tap changer S to the top of the transformer T for inside operation or to bracket 12 and sealing assembly A for wall mount and outside operation. Junction studs 28 are used to hold the transformer high voltage terminals together with nuts and washers. High voltage stud brackets 22 and 24 are disposed outwardly from main portion 26 of frame 16. Studs 28 are secured to bosses 30 and may extend from either side of brackets 22 and 24, as required by the installation.

Figure 3:
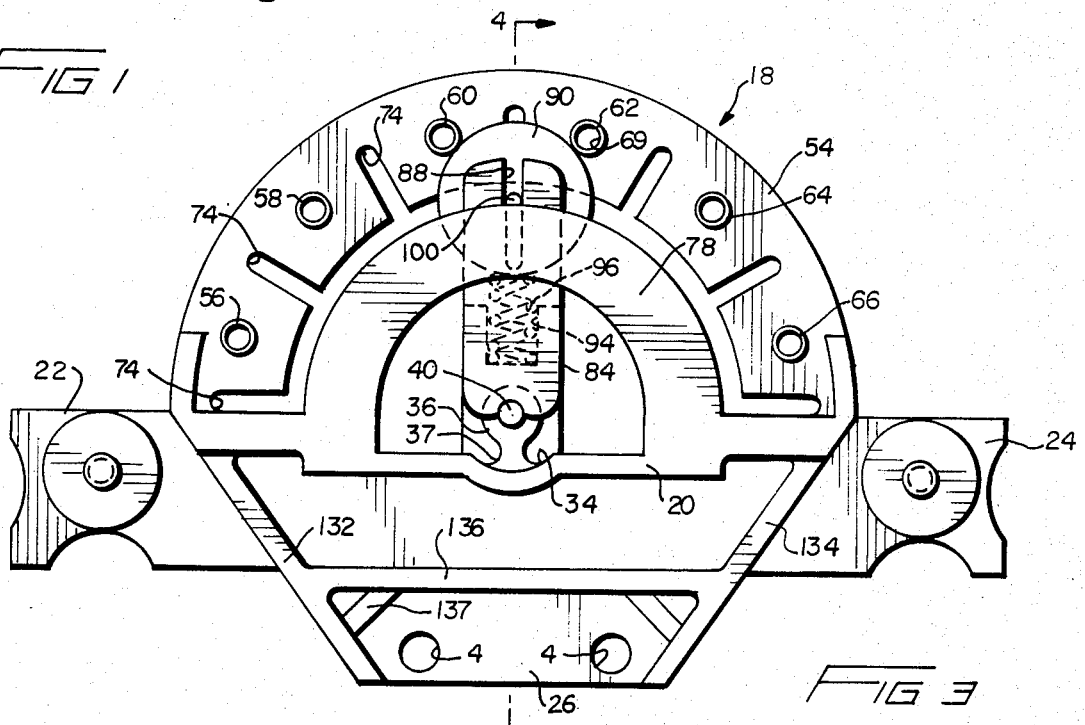
FIG. 3 is a bottom view of the tap changer switch of FIG. 1.

As best shown in FIG. 3, a male coupling member C extends upwardly from recess 34 in flange portion 20. Male coupling member C includes a cylindrical main shaft 36 having substantially 300° of curvature and which depends upwardly from mount 37 and is integral with recess 34. Coaxial stub shafts 38 and 40, best shown in FIG. 6, extend outwardly from the ends of main shaft 36 and define thereby pivot axis 42.

Figure 4:
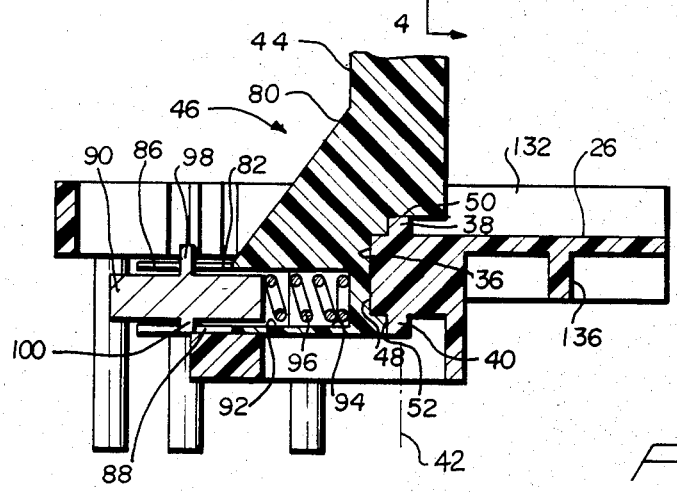
FIG. 4 is a fragmentary cross-sectional view taken along the section 4—4 of FIG. 3 and viewed in the direction of the arrows.

A shaft 44 is rotatably engaged with male coupling member C and includes a support portion 46, as best shown in FIG. 4, which is integral with shaft 44. Support portion 46 has a generally arcuate groove 48 cooperatively engaging main shaft 36. Spaced coaxial arcuate grooves 50 and 52 are cooperatively engaged with stub shafts 38 and 40, respectively, whereby shaft 44 rotates on pivot axis 42 defined by stub shafts 38 and 40. In this way, the female coupling connector or coupling assembly defined by grooves 48, 50 and 52, cooperates with contiguous male coupling member C for providing an assembly permitting rotation of shaft 44 on pivot axis 42. Additionally, coupling C and grooves 48–52 permit snap coupling of shaft 44 to frame 16.

As best shown in FIG. 3, planar portion 18 is of annular configuration and is coaxially centered on pivot axis 42. Planar portion 18 has a first inner side 54 from which contacts 56, 58, 60, 62, 64 and 66 depend. The contacts 56–66 are equally spaced from each other and extend axially parallel to one another and parallel to pivot axis 42. The contacts 56–66 are in electrical communication with tap cables 14 of transformers T and T1.

Figure 7:
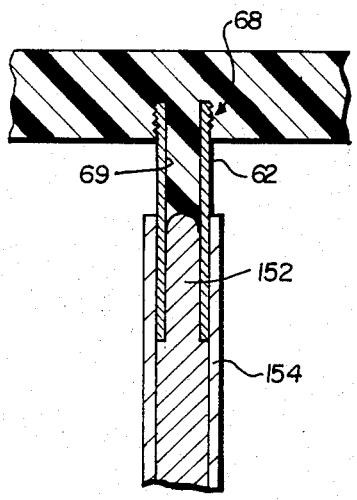

A fragmentary cross-sectional view of contact 62 is disclosed in FIG. 7, but the remaining contacts 56–60 and 64–66 are identical thereto. Contact 62 is manufactured from standard copper tubing and preferably is $\frac{1}{4}''$ or 5/16″0 in diameter. Contact 62 has a flared, knurled or otherwise deformed end 68 adapted to insure that contact 62 remains inserted in the plastic base 18 at the time of molding. A polymeric material, which is preferably 40% glass filled low absorption nylon, such as that manufactured by Dupont under their designation 77G43L, is employed in the manufacture of the tap changer switch S components, including frame 16. The polymeric material fills the internal aperture 69 of the contacts 56–66 a substantial extent to provide a keying effect. In this way, the contacts 56–66 are securely positioned in planar portion 18 while at the same time increasing the strength of the contacts 56–66 in the area where they engage and press against disk 90. This permits the use of a tube wall thin enough to be crimped at the outer end of each of contacts 56–66 around the tap cables 14 and yet strong enough at the contact area 150.

The contact tubes 56–66, as best shown in FIG. 7, are molded parallel to each other due to the core pins 152 and core pin retainers 154 that hold them during molding. The pins 152 and retainers 154 assure parallel insertion to a pre-determined depth into the base 18, thus providing firmly secured contacts 56–66. This results in a maximum contact area 150 between disk 90 and contacts 56–66. The flared, knurled or otherwise deformed end 68 cooperates with and is filled by the polymeric material to further strengthen the contacts 56–66.

As best shown in FIG. 6, planar portion 18 has another side 70 substantially parallel to first side 54. A plurality of ridges 72 are disposed between sides 54 and 70. Slots 74, as best shown in FIG. 3, cooperate with slots 76, as best shown in FIG. 6, and are aligned therewith with the result that each of the contacts 56–66 is associated with, and is positioned in, one of ridges 72. The ridges 72 and their separating slots 74 and 76 serve to prevent electrical tracking when the switch assembly S is suspended in an insulating bath.

As best shown in FIG. 3, an annularly-shaped planar support 78 extends arcuately from flange portion 20. Planar support 78 is coaxially disposed around pivot axis 42 and has an outer diameter less than the outer diameter of planar portion 18. As best shown in FIGS. 2 and 6, planar support 78 is disposed parallel to, and spaced from, planar portion 18 for reasons to be explained herein later. Contacts 56–66 extend outwardly beyond planar support 78, therefore. Contacts 56–66, consequently, maintain a substantially equal distance from planar support 78.

As best shown in FIG. 4, shaft 44 includes a triangularly shaped portion 80 having upwardly depending member 82. An upwardly depending member 84 extends from the front edge of support portion 46. Upwardly depending members 82 and 84 are disposed parallel to each other and generally transverse to pivot axis 42. Member 82 includes a slot 86 which is aligned with a slot 88 in member 84. The slots 86 and 88 serve to guide disk 90 as it is displaced in channel 92 between members 84 and 82. Cylindrical recess 94 is disposed in support portion 46 and aligned with slots 86 and 88 and is adapted for receipt therein of a convolute spring 96 which bears upon the outer periphery of disk 90 for outwardly urging disk 90. Support or brace means 46 includes members 80, 82 and 84 and depends from the forward end of shaft 44.

As best shown in FIG. 4, coaxial shafts 98 and 100 extend outwardly from disk 90 generally parallel to pivot axis 42 and are adapted for sliding action in slots 86 and 88, respectively. It should be noted that shaft 100 is shorter than shaft 98 to prevent engagement of shaft 100 with planar support 78, as best shown in FIG. 3.

Upwardly extending member 84 bears against planar support 78 and member 82 bears against side 54 and thereby position female coupling assembly grooves 48–52 in cooperative engagement with male coupling member C. Simultaneously, spring 96 urges disk 90 outwardly of channel 92 such that disk 90 bears against an adjacent two of the contacts 56–66. It should be obvious that disk 90 has a diameter greater than the spacing between adjacent contacts 56–66. Also, the pressure exerted by spring 96 effects contiguous continuous engagement of the grooved portions 48, 50, and 52 with male coupling member C. Consequently, spring 96 bearing against disk 90 in cooperation with members 82 and 84 bearing against planar support 78 and side 54, respectively, provides positive means for insuring that groove portions 48–52 are cooperatively engaged with male coupling member C to thereby permit free rotation of shaft 44.

One skilled in the art will appreciate that rotation of shaft 44 on pivot axis 42 causes disk 90 to alter its orientation by engaging at least another one of the contacts 56–66 from the two which have been previously contacted, for example contacts 60 and 62 in FIG. 3. When shaft 44 is rotated to the left by one contact in FIG. 3, then disk 90 will engage contacts 58 and 60 while disengaging from contact 62. Similarly, when shaft 44 is rotated two contacts to the left, then disk 90 shorts contacts 56 and 58 while disengaging from contacts 60 and 62, thereby altering the voltage in the primary windings of the transformer T. As the shaft 44 is rotated, either clockwise or counterclockwise, then the disk 90 is displaced inwardly and outwardly on shafts 100 and 98 by the engagement of the disk 90 with the contacts 56–66 until the disk 90 assumes the rest position between an adjacent two contacts, such as contacts 60 and 62. Consequently, the spring 96 bearing against disk 90 serves to insure that the disk 90 is always in contact with two adjacent contacts 56–66 and prevents the disk 90 from being in engagement with only one of the contacts. It should be noted that disk 90 is free to rotate on shafts 98 and 100 on an axis which is parallel to pivot axis 42.

Figure 5:
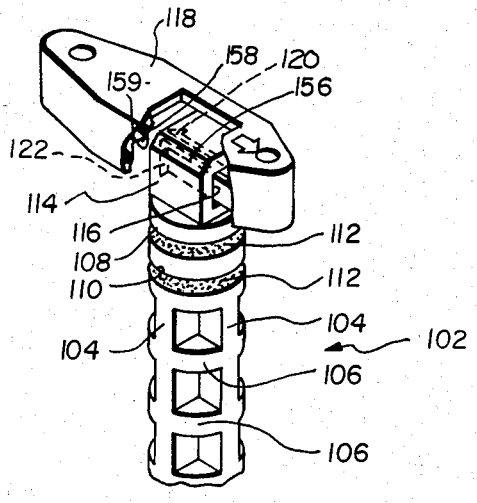
FIG. 5 is a fragmentary perspective view with portions broken away of the shaft and handle of the tap changer switch.

As best shown in FIG. 5, a shaft extension 102 extends outwardly from shaft 44 and includes a plurality of longitudinally disposed members 104 which are reinforced by radial members 106. Sealing grooves 108 and 110 are disposed at substantially the outer end of shaft extension 102. O-rings 112 are disposed in grooves 108 and 110 for reasons to be explained herein later.

Outer end 114 of shaft extension 102 includes a rectangular aperture 116 transverse of pivot axis 42. Handle 118 is disengageably mounted to outer end 114 by cooperating resilient tongues 120 and 122 which are adapted for snap engagement with handle end 114 after passing through aperture 116. The upper part of end 114 is keyed or angularly disposed at 156 and cooperates with underside 158 of handle 118 to allow insertion of the handle only in the correct direction. The underside 158 of handle 118 includes an angularly disposed portion 159 which cooperates with keyed portion 156 for assuring that the handle 118 is properly aligned when installed. Handle 118 may be removed from end 114 by pressing the tongues 120 and 122 inwardly and pulling upwardly and outwardly on the handle 118. Similarly, positioning tongues 120 and 122 adjacent aperture 116 and pulling inwardly and downwardly on handle 118 will cause the tongues 120 and 122 to extend through aperture 116 and engage the outer edge of end portion 114 for thereby securing the handle 118 to shaft portion 114. Consequently, the handle 118 may be quickly and easily disengaged from end 114 while also being quickly and efficiently replaced. This permits the user of the transformer 10 to rotate the contact disk 90 to the appropriate setting and then remove the handle to prevent the setting from being altered.

As best shown in FIG. 2, tap changer S attached to sealing assembly A and mounting bracket 12 has outer end 114 extending beyond transformer tank wall 10. Flanged bushing 129 having an aperture 126 coaxial with pivot axis 42 has groove 160 in the flange for accepting O-ring 162 between the flange and the wall 10 of the transformer T1 and another groove 164 in the outer surface of the bushing 129 for accepting another O-ring 166 between the bushing 129 and annular plate 168. This double seal prevents leakage of oil from the transformer tank. Annular plate 168 has a groove 170 for accepting O-ring 172 between the plate 168 and tank wall 10 of the transformer T1 to further prevent leakage of oil from the tank T1, providing in effect a triple seal. The shaft means provided by shaft 44 and shaft extension 102 is molded with grooves 108 and 110 to accept O-rings 112 between the shaft 102 and the bushing 129, one ring above and one below the transformer tank wall 10 for double sealing of the shaft 102. Nut 174 secures plate 168 to bushing 129 and bracket 12. Annular plate 168 has a central aperture 169 which receives the shaft of bushing 129 and which cooperates with O-ring 166.

As best shown in FIGS. 3 and 4, bracing members 132 and 134 extend outwardly from main portion 26 and serve to reinforce main portion 26 and prevent bending and twisting thereof. Bracing members 132 and 134 are connected by a lateral support 136. Members 132, 134 and 136 also act as tracking barriers between the high voltage terminals 28 and the mounting bolts and bracket attached to holes 4 of the tap changer S. The upper ridges of members 132 and 134 also act as tracking barriers between high voltage junction studs 28 and the mounting bolts and brackets, which are at the same potential as the frame and tank of the transformer. It can be noted in FIG. 4 that male coupling member C extends substantially outwardly beyond main portion 26 and beyond support 136. Slots 137, on main portion 26, further block the tracking path.

While this invention has been described as having a preferred design, it is understood that it is capable of further modifications, uses and/or adaptations of the invention following in general the principles of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A tap changer adapted for being mounted to and operatively engaged with an electrical transformer or the like, comprising:

(a) a frame including means for mounting said frame to a transformer, said frame further including a generally planar portion and a flange portion generally transverse thereto;

(b) a plurality of spaced axially parallel contacts extending from said planar portion for engaging associated contacts of a transformer;

(c) a generally planar support extending from said flange portion parallel to and spaced from said planar portion;

(d) pivot control means extending from said flange portion for defining a pivot axis parallel to and generally equidistant from said contact axes;

(e) shaft means including means cooperatively engaging said pivot control means adapted for permitting rotation of said shaft means on said pivot axis;

(f) brace means extending from said shaft means generally transverse to said pivot axis and adapted for bearing against said planar support for positioning said shaft means in association with said pivot control means;

(g) displaceable disk means associated with said brace means and adapted for simultaneously engaging an adjacent two of said contacts whereby rotation of said shaft means causes said disk means to engage at least another one of said contacts while also disengaging from at least one of the two contacts; and, (h) resilient means associated with said brace means engaged with said disk means for maintaining said disk means in engagement with the two contacts and for maintaining engagement of said shaft means engaging means with said pivot control means.

2. The tap changer as defined in claim 1, wherein:

(a) one of said pivot control means and said cooperatively engaging means includes male coupling means; and, (b) the other one of said pivot control means and said cooperatively engaging means includes female coupling means.

3. The tap changer as defined in claim 2, wherein:

(a) said pivot control means being a male coupling means; and, (b) said cooperatively engaging means being a female coupling means.

4. The tap changer as defined in claim 3, wherein:

(a) said male coupling means includes a generally cylindrical main shaft connected to said flange portion; and, (b) an opposed pair of stub shafts extend coaxially from said main shaft for defining said pivot axis.

5. The tap changer as defined in claim 4, wherein:

(a) said female coupling means includes an arcuate groove cooperatively engaging said main shaft and adapted to permit rotation of said main shaft.

6. The tap changer as defined in claim 5, wherein:

(a) said shaft means further includes a pair of spaced grooves disposed coaxially on either side of said arcuate groove for engaging said stub shafts.

7. The tap changer as defined in claim 6, wherein:

(a) said arcuate groove is disposed proximate one end of said shaft means.

8. The tap changer as defined in claim 1, wherein:

(a) handle means are disengageably mounted to said shaft means on an end thereof spaced from said brace means.

9. The tap changer as defined in claim 1, wherein:

(a) said planar portion and said planar support are annularly shaped and coaxially disposed about said pivot axis.

10. The tap changer as defined in claim 9, wherein:

(a) said planar portion having an outer diameter greater than the outer diameter of said planar support whereby said contacts extend beyond and are equally spaced from said planar support.

11. The tap changer as defined in claim 9, wherein:

(a) said contacts extend from a side of said planar portion adjacent said planar support;

(b) said planar portion includes another side opposite from said first mentioned side; and, (c) a plurality of ridges disposed on said another side for preventing tracking.

12. The tap changer as defined in claim 11, wherein:

(a) each of said ridges associated with one of said contacts;

(b) said ridges being separated from adjacent ridges by slot means; and, (c) said ridges extending generally from said side to said first mentioned another side.

13. The tap changer as defined in claim 12, wherein:

(a) each of said contacts includes a portion thereof embedded within an associated ridge for strengthening said contact, said portion including means for maintaining positive securement of the contact in the associated ridge.

14. The tap changer as defined in claim 1, wherein:

(a) said disk means being displaceably mounted to said brace means.

15. The tap changer as defined in claim 14, wherein:

(a) said brace means includes a pair of spaced parallel members;

(b) one of said members in bearing engagement with said planar support;

(c) each of said members includes guide means;

(d) said disk means includes shaft means extending therefrom and including means for engaging said guide means; and, (e) said resilient means disposed between said members.

16. The tap changer as defined in claim 15, wherein:

(a) a support portion secured to said shaft means generally adjacent said engaging means;

(b) said members extending from said support portion generally transverse of said shaft means axis;
(c) a cylindrical recess disposed in said support portion between said members; and,
(d) spring means disposed within said recess for bearing against said disk means.

17. The tap changer as defined in claim 16, wherein:
(a) said guide means includes a slot in each of said members;
(b) said disk means shaft means includes a pair of opposed coaxial shafts extending from said disk means for engaging said slots; and,
(c) one of said shafts extends a distance beyond said disk a distance exceeding that of the other of said shafts.

18. The tap changer as defined in claim 15, wherein:
(a) said disk means adapted for rotating on said shaft means on an axis parallel to said pivot axis.

19. The tap changer as defined in claim 1, wherein:
(a) said frame and said planar support are integral.

20. The tap changer as defined in claim 1, wherein:
(a) said mounting means includes means for mounting said frame in any one of a vertical and horizontal orientation.

21. The tap changer as defined in claim 1, wherein:
(a) said transformer includes a mounting bracket engaging said mounting means whereby said frame is internally positioned thereby within said transformer and has an end of said shaft means extending generally outwardly therefrom;
(b) bushing means having an aperture therethrough secured to said transformer whereby said shaft means extends beyond said aperture; and,
(c) resilient seal means circumferentially disposed about said shaft means and engaging said bushing means for sealing said transformer thereby.

22. The tap changer as defined in claim 21, wherein:
(a) handle means being connected to said shaft means end extending outwardly from said transformer for rotating said shaft means.

23. The tap changer as defined in claim 1, wherein:
(a) said resilient means includes a spring.

24. The tap changer as defined in claim 21, wherein:
(a) an arcuate recess is generally peripherally disposed about said bushing means adjacent a wall of said transformer; and,
(b) resilient seal means are disposed within said recess.

25. The tap changer as defined in claim 24, wherein:
(a) an annular plate having an aperture therethrough coaxial with said bushing means aperture engages said bushing means adjacent an interior surface of said transformer wall for thereby securing said bushing means and maintaining alignment of said resilient seal means;
(b) said annular plate includes an annular recess adjacent said interior surface;
(c) resilient seal means are disposed within said annular plate recess for thereby sealing said transformer;
(d) said bushing means includes a peripheral recess adjacent said annular plate; and,
(e) resilient seal means are disposed within said peripheral recess.

26. The tap changer as defined in claim 25, wherein:
(a) at least a first groove is peripherally disposed about said shaft means adjacent said bushing means; and,
(b) resilient seal means are disposed within said at least a first groove.

27. The tap changer as defined in claim 22, wherein:
(a) said handle means includes means cooperating with said shaft means for assuring proper alignment of said handle means when installed thereon.

28. The tap changer as defined in claim 27, wherein:
(a) said handle means includes an angularly disposed portion; and,
(b) said shaft means end includes an angularly disposed portion whereby said handle means angularly disposed portion is aligned with said shaft means angularly disposed portion for thereby assuring proper alignment of said handle means.

29. A tap changer adapted for being mounted to and operatively engaged with an electrical transformer or the like, comprising:
(a) a frame including means for mounting said frame to a transformer, said frame further including a generally planar portion and a flange portion with spaced ends and said planar portion extending generally transverse to said flange portion from one of said ends;
(b) a plurality of spaced axially parallel contacts extending from said planar portion for engaging associated contacts of the transformer;
(c) a generally planar support extending from a second end of said flange portion parallel to and spaced from said planar portion;
(d) pivot control means extending from said flange portion and disposed between said ends for defining a pivot axis parallel to and generally equidistant from said contact axes;
(e) shaft means including means cooperatively engaging said pivot control means adapted for permitting rotation of said shaft means on said pivot axis;
(f) brace means extending from said shaft means generally transverse to said pivot axis and adapted for bearing against said planar support for positioning said shaft means in association with said pivot control means;
(g) displaceable disk means associated with said brace means and adapted for simultaneously engaging an adjacent two of said contacts whereby rotation of said shaft means causes said disk means to engage at least another one of said contacts while also disengaging from at least one of the two contacts; and,
(h) resilient means associated with said brace means engaged with said disk means for maintaining said disk means in engagement with the two contacts and for maintaining engagement of said shaft means engaging means with said pivot control means.

* * * * *